US009905353B2

(12) United States Patent
Willis

(10) Patent No.: US 9,905,353 B2
(45) Date of Patent: Feb. 27, 2018

(54) CONSTRUCTION OF DOUBLE GAP INDUCTOR

(71) Applicant: HIQ SOLAR, INC., Santa Clara, CA (US)

(72) Inventor: Andre P. Willis, Palo Alto, CA (US)

(73) Assignee: HIQ SOLAR, INC., Santa Clara, CA (US)

( * ) Notice: Subject to any disclaimer, the term of this patent is extended or adjusted under 35 U.S.C. 154(b) by 0 days.

(21) Appl. No.: 14/864,205

(22) Filed: Sep. 24, 2015

(65) Prior Publication Data

US 2016/0189847 A1 Jun. 30, 2016

Related U.S. Application Data

(60) Provisional application No. 62/054,507, filed on Sep. 24, 2014.

(51) Int. Cl.

| | |
|---|---|
| ***H01F 17/06*** | (2006.01) |
| ***H01F 27/24*** | (2006.01) |
| ***H01F 7/06*** | (2006.01) |
| ***H01F 41/02*** | (2006.01) |
| ***H01F 3/14*** | (2006.01) |
| ***H01F 27/26*** | (2006.01) |
| ***H01F 37/00*** | (2006.01) |

(52) U.S. Cl.

CPC ..... *H01F 27/24* (2013.01); *H01F 3/14* (2013.01); *H01F 27/263* (2013.01); *H01F 37/00* (2013.01); *H01F 41/0206* (2013.01)

(58) Field of Classification Search

CPC ..... H01F 27/24; H01F 3/10; H01F 3/14

USPC ..... 336/212, 178, 214, 215; 29/607

See application file for complete search history.

(56) References Cited

U.S. PATENT DOCUMENTS

| | | | | |
|---|---|---|---|---|
| 3,316,515 | A * | 4/1967 | Bock | H01F 27/245 336/100 |
| 4,591,819 | A * | 5/1986 | Nero | H01F 3/14 29/606 |
| 5,754,087 | A * | 5/1998 | Goseberg | H01F 3/14 336/165 |
| 6,980,077 | B1 * | 12/2005 | Chandrasekaran | H01F 27/255 336/212 |
| 2004/0085173 | A1 * | 5/2004 | Decristofaro | H01F 27/245 336/178 |
| 2006/0114093 | A1 | 6/2006 | Sutardja | |
| 2006/0192646 | A1 | 8/2006 | Hanley | |
| 2009/0237197 | A1 | 9/2009 | Ikriannikov et al. | |
| 2010/0194512 | A1 * | 8/2010 | Pieteris | H01F 3/14 336/110 |
| 2014/0085035 | A1 * | 3/2014 | Kim | H01F 27/24 336/212 |

(Continued)

OTHER PUBLICATIONS

International Search Report and Written Opinion filed in PCT/US2015/051945, dated Jan. 14, 2016; 10 pgs.

*Primary Examiner* — Mangtin Lian

(74) *Attorney, Agent, or Firm* — Heimlich Law, PC; Alan Heimlich, Esq.

(57) ABSTRACT

A low loss power inductor core and method for making same. The magnetic core includes an outer portion formed as a closed loop from multiple magnetic core pieces, and inner portion disposed within the closed loop. Non-magnetic spacers at opposing ends of the inner core portion position and secure the inner core portion between mutually opposed inner sides of the closed loop.

20 Claims, 5 Drawing Sheets

(56) References Cited

U.S. PATENT DOCUMENTS

| | | | |
|---|---|---|---|
| 2014/0266535 | A1 | 9/2014 | Willis |
| 2014/0266539 | A1 | 9/2014 | Krishnamoorthy et al. |

* cited by examiner

CONSTRUCTION OF DOUBLE GAP INDUCTOR

RELATED APPLICATIONS

This application claims priority to and the benefit of U.S. Patent Application 62/054,507, entitled "Novel Construction of Double-Gap Inductor," filed on Sep. 24, 2014, the disclosure of which is incorporated herein by reference.

BACKGROUND

The present invention relates to inductors, and in particular, to inductors for storing energy in high power applications.

Previous patent applications (U.S. Pat. App. 61/782,457 filed Mar. 14, 2013 and entitled "Low loss inductor windings using offset gap, offset windings", and U.S. patent application Ser. No. 14/206,511 filed Mar. 12, 2014 and entitled "Low Loss Inductor With Offset Gap and Windings", all contents of both of which are incorporated herein by reference) described a novel method of winding conducting foil around a magnetic core assembly. That assembly employed a common implementation where the magnetic core has a dimensionally controlled non-magnetic gap between one end of the center core finger (or center leg) and an adjacent magnetic component. A development of such an assembly is to have the magnetic core suspended such that each end of the core has a dimensionally controlled non-magnetic gap between it and surrounding magnetic material. This application describes the mechanical support of such a dual non-magnetic gap core.

SUMMARY

In accordance with the presently claimed invention, a low loss power inductor core and method for making same are provided. The magnetic core includes an outer portion formed as a closed loop from multiple magnetic core pieces, and inner portion disposed within the closed loop. Non-magnetic spacers at opposing ends of the inner core portion position and secure the inner core portion between mutually opposed inner sides of the closed loop.

In accordance with one embodiment of the presently claimed invention, a low loss power inductor core includes: an outer magnetic core portion including a plurality of magnetic core pieces disposed to form a closed loop; an inner magnetic core portion including mutually opposed first and second ends separated by an l-shaped magnetic core piece and disposed within the closed loop; a first non-magnetic spacer disposed between the first end and a first inner side of the closed loop; and a second non-magnetic spacer disposed between the second end and a second inner side of the closed loop.

In accordance with another embodiment of the presently claimed invention, a low loss power inductor core includes: forming a closed loop with a plurality of magnetic core pieces as an outer magnetic core portion; positioning an l-shaped magnetic core piece including mutually opposed first and second ends within the closed loop as an inner magnetic core portion; positioning a first non-magnetic spacer between the first end and a first inner side of the closed loop; and positioning a second non-magnetic spacer between the second end and a second inner side of the closed loop.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Figure 1:
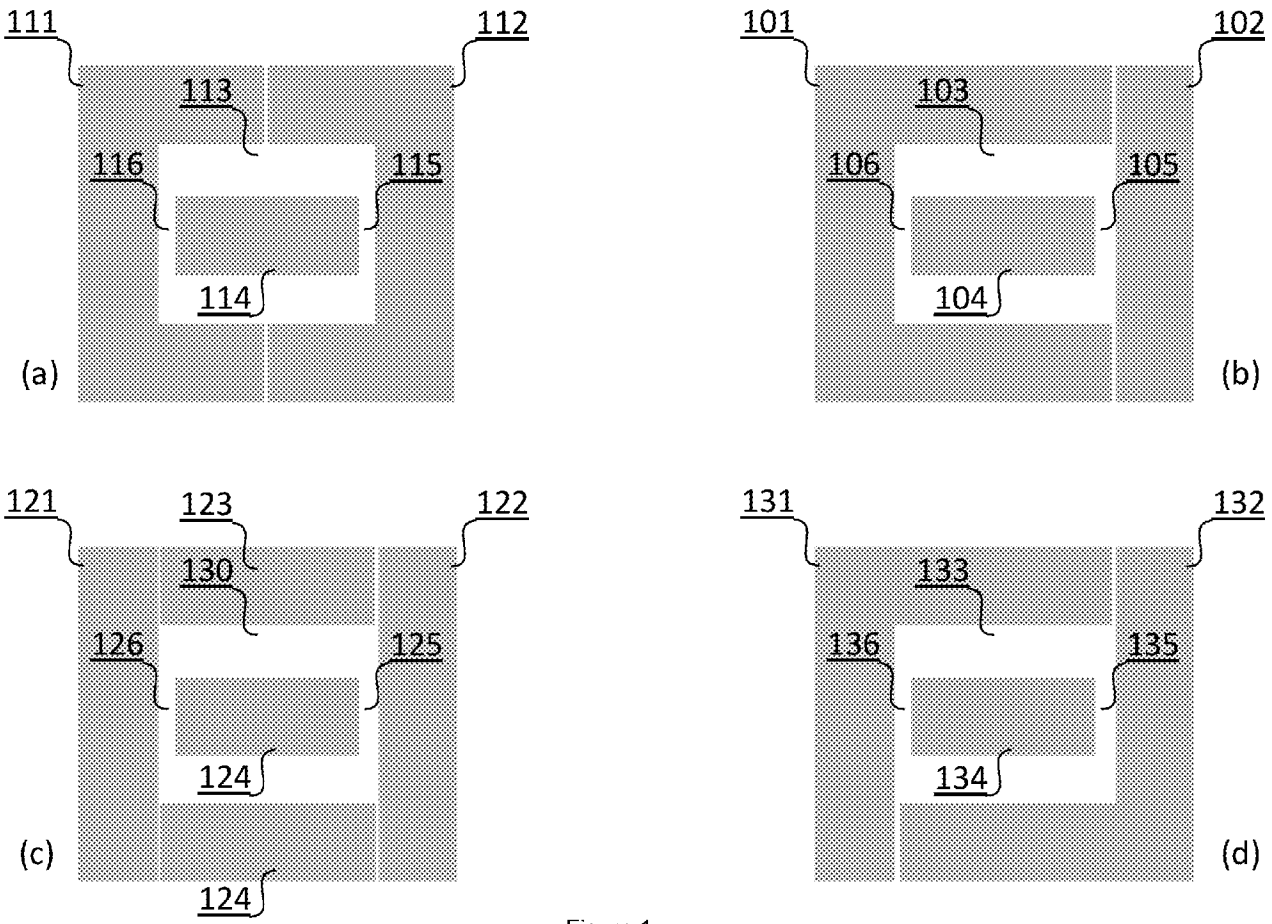
FIG. 1A depicts an inductor core in accordance with an exemplary embodiment of the presently claimed invention.
FIG. 1B depicts an inductor core in accordance with another exemplary embodiment of the presently claimed invention.
FIG. 1C depicts an inductor core in accordance with another exemplary embodiment of the presently claimed invention.
FIG. 1D depicts an inductor core in accordance with another exemplary embodiment of the presently claimed invention.

FIG. 1 (*a*) shows the cross section of an assembly composed of two 'U' shaped pieces (111, 112) made of magnetic materials that connect together while leaving an air-filled volume in the center (113). In the air-filled volume in the center of the assembly (113) it is desired to place a further core (114) made of magnetic material such that it is suspended in the center and forming non-magnetic gaps (115, 116) that are a carefully controlled distance from the other two pieces of magnetic material. The precisely controlled non-magnetic gaps (115, 116) are important for optimum performance of the magnetic assembly.

FIG. 1 (*b*) shows the cross section of an alternative construction assembly composed of a 'U' shaped piece (101) and 'I' shaped piece (102) made of magnetic materials that connect together while leaving an air-filled volume in the center (103). In the air-filled volume in the center of the assembly (103) it is desired to place a further core (104) made of magnetic material such that it is suspended in the center and forming non-magnetic gaps (105, 106) that are a carefully controlled distance from the other two pieces of magnetic material. The precisely controlled non-magnetic gaps (105, 106) are important for optimum performance of the magnetic assembly.

FIG. 1 (*c*) shows the cross section of an alternative construction assembly composed of shaped pieces (121, 122, 123, 124) made of magnetic materials that connect together while leaving an air-filled volume in the center (130). In the air-filled volume in the center of the assembly (130) it is desired to place a further core (124) made of magnetic material such that it is suspended in the center and forming non-magnetic gaps (125, 126) that are a carefully controlled distance from the other pieces of magnetic material (121, 122). The precisely controlled non-magnetic gaps (125, 126) are important for optimum performance of the magnetic assembly.

FIG. 1 (*d*) shows the cross section of an alternative construction assembly composed of two 'L' shaped pieces (131, 132) made of magnetic materials that connect together while leaving an air-filled volume in the center (133). In the air-filled volume in the center of the assembly (133) it is desired to place a further core (134) made of magnetic material such that it is suspended in the center and forming non-magnetic gaps (135, 136) that are a carefully controlled distance from the other two pieces of magnetic material. The precisely controlled non-magnetic gaps (135, 136) are important for optimum performance of the magnetic assembly.

Figure 2:
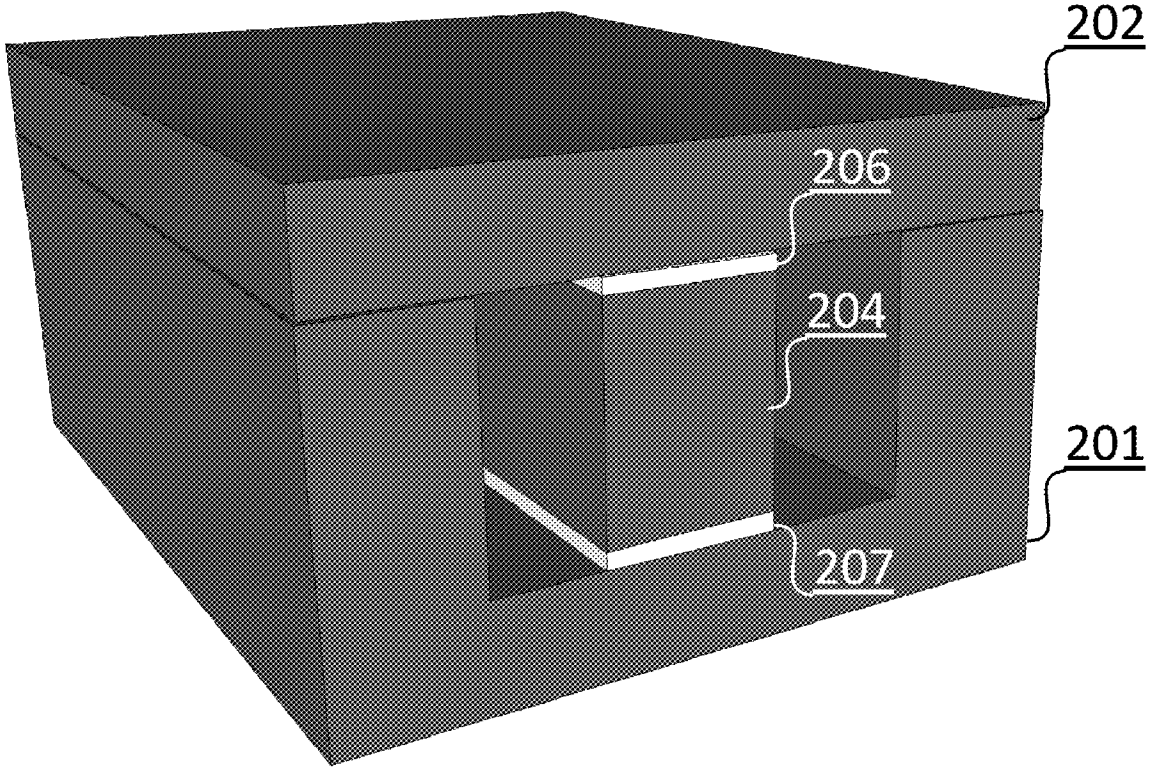
FIG. 2 depicts an alternative view of the core of FIG. 1B.

An alternative view of FIG. 1 (*b*) is shown in FIG. 2. The same 'U' shaped piece (101) is shown (201) along with the 'I' shaped piece (102) shown (202). The core (104) is shown (204).

Figure 3:
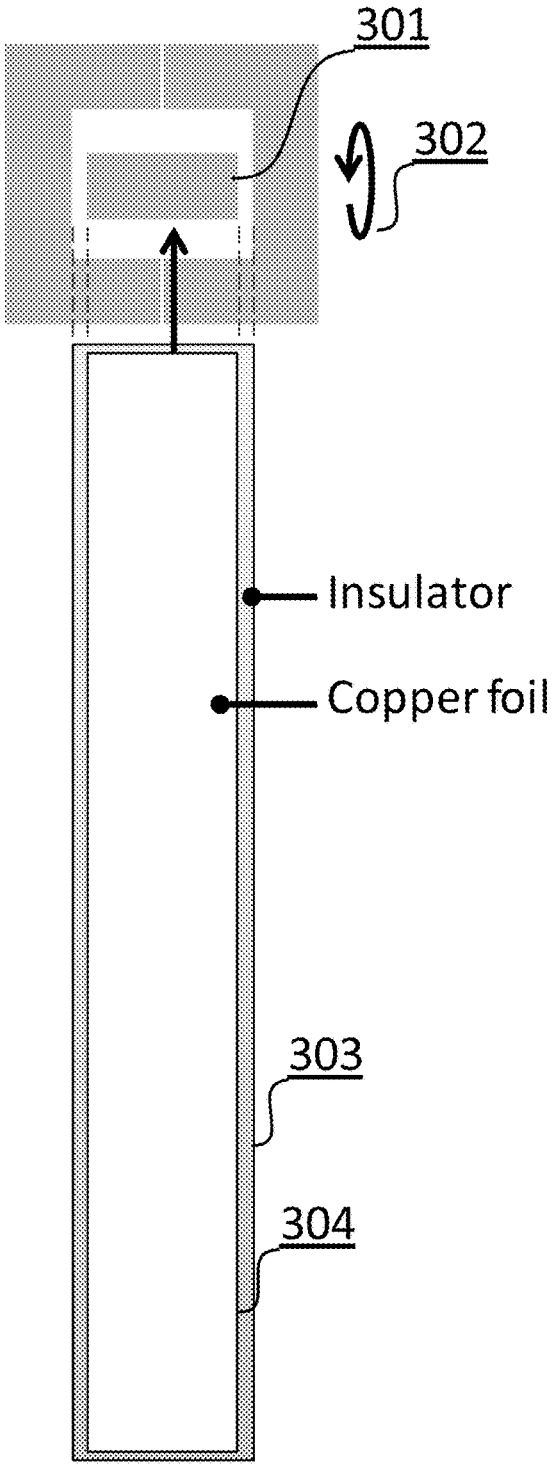
FIG. 3 depicts an exemplary foil of copper and insulator for winding about the core.

The next step in constructing the inductor is to wind a length of insulated copper around the core. In power electronics this is often copper foil, as shown in FIG. 3. Here a sheet of copper (304) is wrapped (302) along with an insulating sheet (303) around the core (301) of the inductor including the non-magnetic gap.

In order to mechanically support the core (204), the air gaps (105, 106) are filled with spacer pieces (206, 207). The spacer pieces (206, 207) must ideally exhibit low loss for any magnetic field, provide physical support to maintain the core's location, and have a coefficient of thermal expansion that is similar enough to the surrounding magnetic material such that mechanical stress within the assembly is minimized. In addition the spacer and glue should exhibit high thermal conductivity to aid heat dissipation from the core (204). Examples of materials for such spacers (206, 207) include, without limitation, carbon fiber composites, beryllium oxide ceramics and beryllium oxide-filled epoxies.

Figure 4:
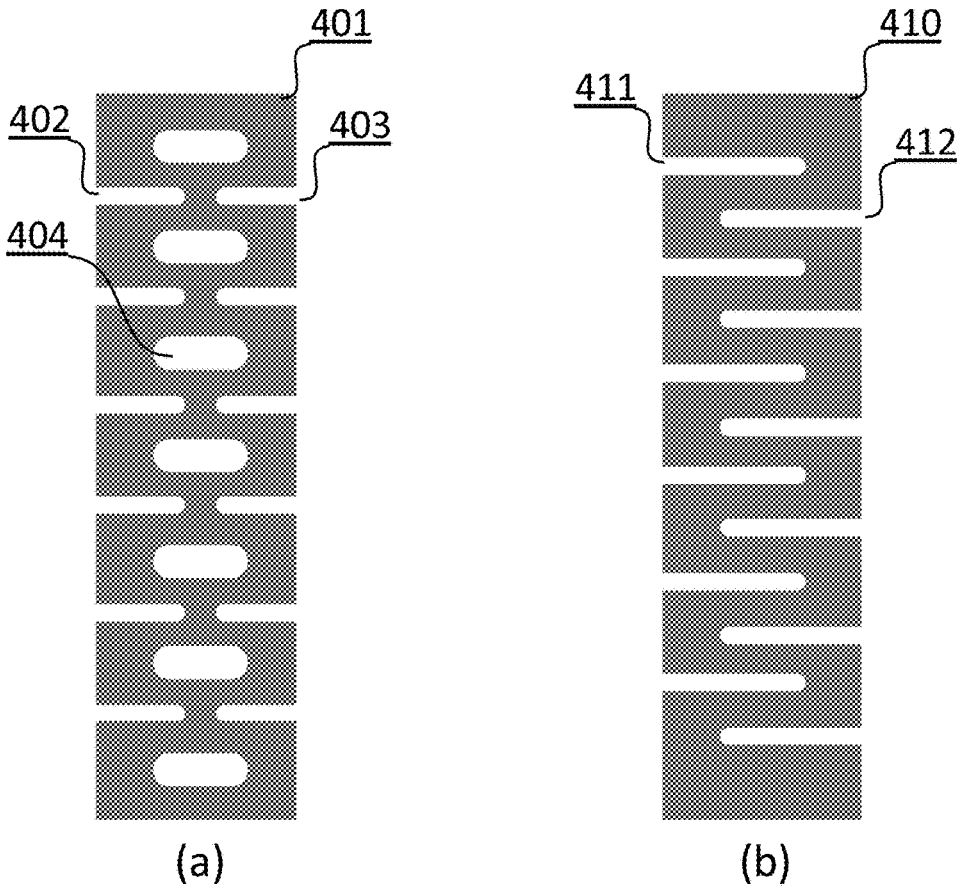
FIG. 4A depicts a spacer for use in assembling an inductor core in accordance with an exemplary embodiment of the presently claimed invention.
FIG. 4B depicts a spacer for use in assembling an inductor core in accordance with another exemplary embodiment of the presently claimed invention.

FIG. 4 shows different implementations of such a spacer (206, 207). FIG. 4 (*a*) shows the preferred implementation, a formed piece (401) that is the same width and length as the core (204), and thickness as the desired non-magnetic gap (105, 106). It has enclosed slots (404) into which glue may be inserted prior to fitment together of the magnetic assembly shown in FIG. 2 to permanently attach the components (201, 202, 204). In addition, the formed piece (401) has slots (402, 403) cutting into either side of the formed piece (401). These allow the formed piece (401) flexibility to expand along its length by an amount that matches the thermal expansion of the magnetic materials to which it is attached (201, 204, or 202, 204).

FIG. 4 (*b*) shows an alternative implementation (410) without dedicated enclosed slots (such as 404) for containment of glue. Instead, slots (411, 412) provide expansion flexibility and containment for glue.

Figure 5:
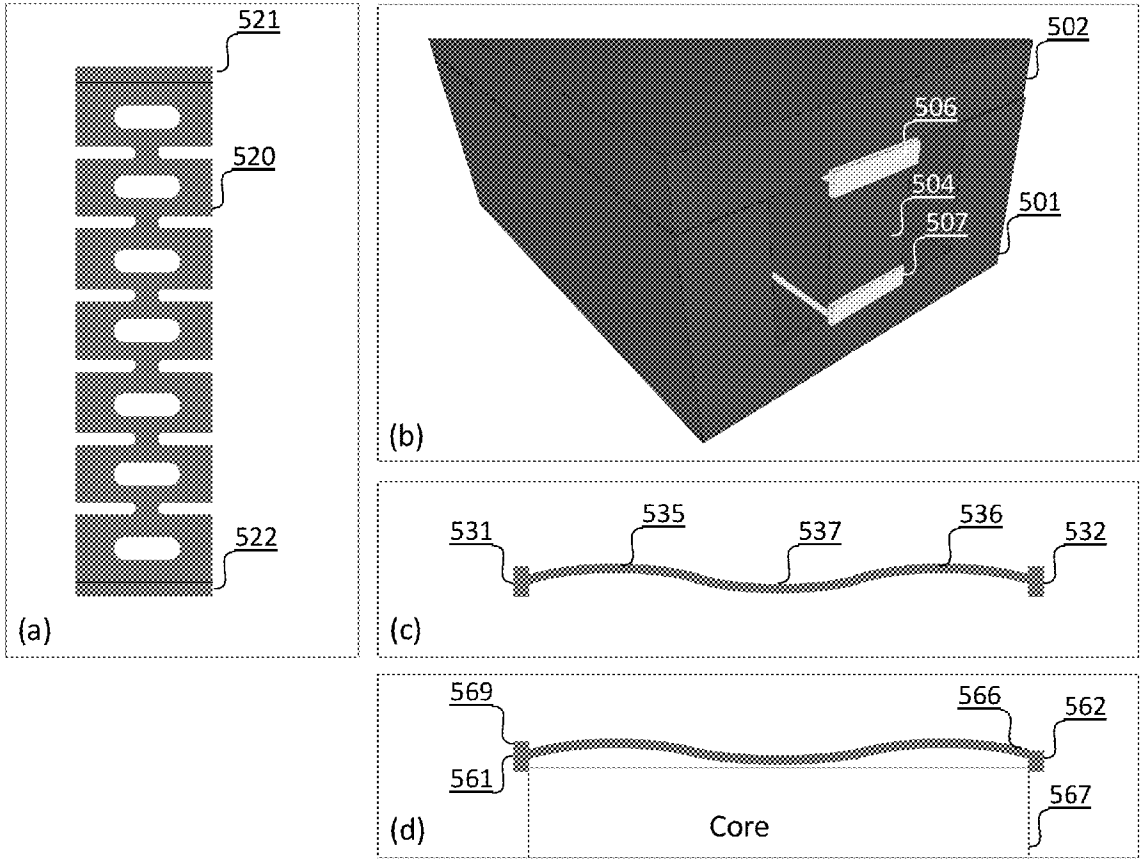
FIG. 5A depicts an alternative spacer for use in assembling an inductor core in accordance with exemplary embodiment of the presently claimed invention.
FIG. 5B depicts an alternative spacer for use in assembling an inductor core in accordance with another exemplary embodiment of the presently claimed invention.
FIG. 5C depicts an alternative spacer for use in assembling an inductor core in accordance with another exemplary embodiment of the presently claimed invention.
FIG. 5D depicts an alternative spacer for use in assembling an inductor core in accordance with another exemplary embodiment of the presently claimed invention.

FIG. 5 (*a*) shows an enhancement of the spacer (401, 520) where each end (521, 522) is formed so that a small section is thicker, and sized so that it overhangs the magnetic cores as shown in FIG. 5 (*b*). Ends (506, 507, 521, 522) of spacers (520) aid maintenance of core position relative to the other magnetic pieces (501, 502).

An additional enhancement to the design of the preferred implementation (401) is shown in FIG. 5 (*c*), also shown with spacer ends (521, 522, 531, 532) in this example. FIG. 5 (*c*) shows the preferred implementation (401, 520) from the side with the addition of a ripple in the material (535, 536, 537) that causes the spacer to not be flat when it connects to the core (504) face and the U-shaped piece (501). This difference in height is introduced in the design of the spacer in order to cause size equalization of the two non-magnetic gaps (105, 106, 115, 116), and flexibility in thermal expansion of the spacer. Using the implementation of FIG. 5 (*c*) an alternative implementation would omit use of epoxy as a fixing aid as the spacer design and windings (303, 304) are sufficient to maintain core (114, 104, 204, 504) position.

Referring to FIG. 5 (*b*) as an example, assembly of inductors described here may be achieved by placing the core (504) into the body (501), then placing the top piece (502) in position. Alternatively, the body (501) and top piece (502) may be assembled, and then the core slid into position. For this second assembly method, FIG. 5 (*d*) shows a further design enhancement to the spacers used. The enhancement uses the embodiment of FIG. 5 (*c*) but can be applied to the other implementations with end caps such as (521, 522, 531, 532, 561, 562). The enhancement is to form the end cap at one end of the spacer to be shorter than described in previous examples. In FIG. 5 (*d*) the end cap (562) is shorter, flush with the surface of the spacer opposite to the core. This enables the core assembly to be slid into position without interference. The other end cap (561) retains the extra height (569) of the original end cap design, and this will provide an end stop to ensure that the core cannot be slid beyond its correct location. In FIG. 5 (*d*) the lower portions of both end caps (561, 562) act to grip the core (567), aiding easy assembly.

Various other modifications and alterations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a low loss power inductor core, comprising:

an outer magnetic core portion including a plurality of magnetic core pieces disposed to form a closed loop;

an inner magnetic core portion including mutually opposed first and second ends separated by an l-shaped magnetic core piece and disposed within said closed loop;

a first non-magnetic spacer disposed between said first end and a first inner side of said closed loop; and a second non-magnetic spacer disposed between said second end and a second inner side of said closed loop, wherein said first and second non-magnetic spacers each include a first end cap and a second end cap, wherein said first and second non-magnetic spacers have a width and a length, wherein said first and second non-magnetic spacers comprise unitary structures including a plurality of slots along said length, and wherein said plurality of slots allow said first and second non-magnetic spacers to expand lengthwise.

2. The apparatus of claim 1, wherein said plurality of magnetic core pieces comprises mutually opposed first and second C-shaped magnetic core pieces.

3. The apparatus of claim 1, wherein said plurality of magnetic core pieces comprises mutually opposed first and second L-shaped magnetic core pieces.

4. The apparatus of claim 1, wherein said plurality of magnetic core pieces comprises:

a C-shaped magnetic core piece; and an l-shaped magnetic core piece adjacent an open edge of said C-shaped magnetic core piece.

5. The apparatus of claim 1, wherein said plurality of magnetic core pieces comprises:

mutually parallel first and second l-shaped magnetic core pieces parallel with said inner magnetic core portion; and mutually parallel third and fourth l-shaped magnetic core pieces parallel perpendicular to said inner magnetic core portion.

6. The apparatus of claim 1, wherein:

said first non-magnetic spacer is mechanically secured between said first end and said first inner side; and said second non-magnetic spacer is mechanically secured between said second end and said second inner side.

7. The apparatus of claim 1, wherein:

said first non-magnetic spacer is adhesively secured between said first end and said first inner side; and said second non-magnetic spacer is adhesively secured between said second end and said second inner side.

8. The apparatus of claim 1, wherein:

said first non-magnetic spacer is longitudinally rippled and in compressed physical contact with said first end and said first inner side; and said second non-magnetic spacer is longitudinally rippled and in compressed physical contact with said second end and said second inner side.

9. The apparatus of claim 1, wherein at least one longitudinal end of at least one of said first and second non-magnetic spacers is thicker in cross-section than a remaining portion of said at least one of said first and second non-magnetic spacers.

10. The apparatus of claim 1, wherein said plurality of slots allow said first and second non-magnetic spacers to expand lengthwise to match a thermal expansion of said outer magnetic core portion and said inner magnetic core portion.

11. The apparatus of claim 1, wherein said first end cap is shorter than said second end cap.

12. A method for making a low loss power inductor core, comprising:

forming a closed loop with a plurality of magnetic core pieces as an outer magnetic core portion;

positioning an l-shaped magnetic core piece including mutually opposed first and second ends within said closed loop as an inner magnetic core portion;

positioning a first non-magnetic spacer between said first end and a first inner side of said closed loop; and positioning a second non-magnetic spacer between said second end and a second inner side of said closed loop, wherein said first and second non-magnetic spacers each include a first end cap and a second end cap, wherein said first and second non-magnetic spacers have a width and a length, wherein said first and second non-magnetic spacers comprise unitary structures including a plurality of slots along said length, and wherein said plurality of slots allow said first and second non-magnetic spacers to expand lengthwise.

13. The method of claim 12, wherein said plurality of magnetic core pieces comprises mutually opposed first and second C-shaped magnetic core pieces.

14. The method of claim 12, wherein said plurality of magnetic core pieces comprises mutually opposed first and second L-shaped magnetic core pieces.

15. The method of claim 12, wherein said plurality of magnetic core pieces comprises:

a C-shaped magnetic core piece; and an l-shaped magnetic core piece adjacent an open edge of said C-shaped magnetic core piece.

16. The method of claim 12, wherein said plurality of magnetic core pieces comprises:

mutually parallel first and second l-shaped magnetic core pieces parallel with said inner magnetic core portion; and mutually parallel third and fourth l-shaped magnetic core pieces parallel perpendicular to said inner magnetic core portion.

17. The method of claim 12, wherein:

positioning a first non-magnetic spacer comprises mechanically securing said first non-magnetic spacer between said first end and said first inner side; and positioning a second non-magnetic spacer comprises mechanically securing said second non-magnetic spacer between said second end and said second inner side.

18. The method of claim 12, wherein:

positioning a first non-magnetic spacer comprises adhesively securing said first non-magnetic spacer between said first end and said first inner side; and positioning a second non-magnetic spacer comprises adhesively securing said second non-magnetic spacer between said second end and said second inner side.

19. The method of claim 12, wherein:

positioning a first non-magnetic spacer comprises positioning a first longitudinally rippled non-magnetic spacer in compressed physical contact with said first end and said first inner side; and positioning a second non-magnetic spacer comprises positioning a second longitudinally rippled non-magnetic spacer in compressed physical contact with said second end and said second inner side.

20. The method of claim 12, wherein at least one longitudinal end of at least one of said first and second non-magnetic spacers is thicker in cross-section than a remaining portion of said at least one of said first and second non-magnetic spacers.

* * * * *